United States Patent [19]

Skinner et al.

[11] Patent Number: 4,819,410

[45] Date of Patent: Apr. 11, 1989

[54] METHOD AND APPARATUS FOR ATTACHING A HANDLE TO A GROUP OF CARTONS

[75] Inventors: Edward A. Skinner; Donald E. House, both of Welwyn Garden City, United Kingdom

[73] Assignee: Elopak Limited, Hertfordshire, England

[21] Appl. No.: 79,094

[22] Filed: Jul. 29, 1987

[51] Int. Cl.[4] ..... B65B 61/14

[52] U.S. Cl. ..... 53/413; 53/48; 53/134; 493/909

[58] Field of Search ..... 53/413, 134, 135, 48; 493/88, 909; 229/52 A, 52 AL; 206/602

[56] References Cited

U.S. PATENT DOCUMENTS

| | | | |
|---|---|---|---|
| 2,766,567 | 10/1956 | Fahrenbach et al. | 53/413 X |
| 2,885,839 | 5/1959 | Weiss | 53/413 X |
| 3,114,496 | 12/1963 | Wilcox | 229/52 AL |
| 3,221,876 | 12/1965 | Currie | 229/52 A X |
| 3,808,957 | 5/1974 | Hosoya et al. | 493/909 X |
| 4,238,256 | 12/1980 | Faust et al. | 156/199 X |

*Primary Examiner*—James F. Coan

*Attorney, Agent, or Firm*—Pravel, Gambrell, Hewitt, Kimball & Krieger

[57] ABSTRACT

Filled and top-sealed cartons are fed in a line to a chamber supplied with dehumidified warm air and short rows, each of two or three cartons, are pushed consecutively and laterally at a grouping station by a vertical plate onto a carrier, which advances the rows in turn through a side-taping station. At the grouping station, a tape-gripping device draws off consecutively from a roll of non-adhesive tape predetermined lengths of the tape, which are gripped at their middle sections in turn and are cut off from the roll, the cut-off end zones falling down to respective opposite sides of the row. The cut-off lengths are advanced with the respective rows through the side-taping station, which has a pair of adhesive-tape-applying rolls at those respective opposite sides and at which respective side tapes are applied to adhere together the cartons of the row and the handle of the row.

19 Claims, 6 Drawing Sheets

METHOD AND APPARATUS FOR ATTACHING A HANDLE TO A GROUP OF CARTONS

BACKGROUND OF THE INVENTION

1. Field of the Invention

This invention relates to the applying of handles to articles and the taping together of articles.

2. Description of the Prior Art

British Patent Specification No. 1383108 discloses an apparatus for use in fitting to a carton a handle consisting of a piece of adhesive tape and a piece of opaque paper adhering to the adhesive side of the middle section of the piece of adhesive tape, which is adhered at both ends to shoulders of the carton. The apparatus includes a conveying device for intermittently moving the carton along a path to a handle-applying station, a turntable adjacent the path and intermittently angularly displaceable about a vertical axis, in unison with the intermittent movement of the conveying device, the turntable including suction pads to take up tape around its periphery, a cutting device for cutting off the tape on the turntable to give predetermined lengths forming the handles, extensible press arms within the turntable and distributed in pairs therearound for displacing the ends of the handle pieces off the periphery of the turntable at the above station to press those ends onto the carton, and a stop plate interposable between the turntable and the path, during extension of the press arms, to intercept the middle section of each handle piece to prevent contact of the middle section with the carton to form a gap for receiving the fingers of the purchaser of the carton. This system utilizes a bulky and complicated apparatus; it also employs an adhesive handle, which in turn requires a non-adhesive covering at the middle section for grasping by the purchaser. Moreover, the handle can move relative to the plate during attaching of the handle to the carton, so that the handle becomes incorrectly positioned on the carton. Furthermore, the advancing of the carton is interrupted for the attaching of the handle.

European Patent Specification No. 0174015 describes a system similar to that just described but with the significant differences that the adhesive handle is applied to an article comprised of two or more packs integrally packaged or wrapped, and that the turntable is replaced by a drum rotating about a horizontal axis parallel to the path of the articles. This system again utilizes a bulky and complicated apparatus and employs an adhesive handle requiring a non-adhesive covering . Once again, the handle can move relative to the plate during attaching and the advancing of the article is interrupted for the attaching of the handle.

U.S. Pat. No. 4,238,256 discloses a system that forms a ladder-like tape assembly, applies the assembly to a series of bottles moving spaced-apart along a conveyor with a transverse tape aligned with each bottle, and then severs the side tapes between the bottles and adheres the severed portions thereto to provide flexible bails for the bottles. The two side tapes have pressure-sensitive adhesive on their inside surfaces in order to adhere to the bottles and to the outside surfaces of the two end zones of each transverse tape, whilst each transverse tape has pressure-sensitive adhesive at the inside surfaces of its two end zones in order to adhere to its bottle. The means for forming the transverse tapes preferably forms them from a pressure - sensitive - adhesive - coated web having a width corresponding to the length of the bails desired, and a second web having a width less than that of the first web. Means are included for laminating the second web centrally on the adhesive - coated surface of the first web, as are means for transversely severing the laminate thus formed to provide the bails. This system again utilizes a bulky and complicated apparatus and employs an adhesive handle requiring a non-adhesive covering.

A system of taping together a plurality of liquid-containing, rectangular-section cartons is known in which the packs are fed horizontally to a side-taping station at which the cartons are attached together by automatically applying horizontally along the respective opposite sides of the cartons respective adhesive tapes. The apparatus employed includes two reels disposed at respective opposite sides of the path of the cartons and on which respective rolls of adhesive tape are mounted for rotation about respective vertical axes. It also includes two perforating devices at respective opposite sides of the path for perforating the tapes each along a top edge band and a bottom edge band, to enable the cartons to be more easily separated by the purchaser. The system thereby produces row-form groups of two or more cartons wherein the cartons of each group are side - taped together.

A similar system is known from European Patent Specification No. 0135360, in which the rolls of adhesive tape are mounted for rotation about horizontal axes and apply respective tapes to the top and bottom of the cartons. Perforating rollers perforate each tape with spaced rows of perforations arranged to be located between adjacent cartons, each fifth row, say, containing more perforations. There are means for breaking the tapes at each fifth row to separate the cartons into groups of five, say. Such means comprises a pressure roller arranged to engage the top surface of the cartons and a cam roller spaced behind the pressure roller by a distance not greater than the distance between alternate cartons. The cam roller is formed with a projection and disposed immediately below the cartons to rotate once during the passage of every five cartons, say. The projection will engage the underside of every fifth carton and lift the carton to fracture the top and bottom tapes between it and the carton immediately ahead, which is held down by the pressure roller. A difficulty with this system is that the cartons in each group should be firmly compressed together to give a solid feel to the article constituted by each group, yet such firm compression of the advancing line of cartons militates against lifting of every fifth carton, say, to fracture the tapes.

A somewhat similar system, but without perforation of the tapes, is disclosed in U.S. Pat. No. 2,456,059, wherein an advancing line of cartons are tightly pressed together and are maintained in that condition during the application of top and bottom tapes and until an adhesive employed has become substantially set. Then the tapes are severed by means of knives so as to separate the cartons into groups of two or more. A difficulty with this system is that the relative positions of the knives, the tapes and the cartons must be very accurately maintained, otherwise the knives cut into walls of the cartons and/or fail to sever the tapes.

SUMMARY OF THE INVENTION

According to a first aspect of the present invention, there is provided a method of attaching together an article and a handle, comprising bringing respective portions of tape to adjacent to respective opposite sides of the article, bringing respective opposite end zones of the handle to said respective opposite sides of the article, and automatically and adhesively attaching together the tapes, the article and the handle at said respective opposite sides of the article, wherein the improvement is that said respective opposite end zones are brought to said respective opposite sides before said tapes are applied to said handle.

According to a second aspect of the present invention, there is provided apparatus for attaching together an article and a handle, comprising first means arranged to bring respective opposite end zones of the handle to respective opposite sides of the article, and second means arranged to bring respective portions of tape to adjacent to said respective opposite sides of the article and arranged automatically and adhesively to attach together the tapes, the article and the handle at said respective opposite sides of the article, wherein the improvement is that said first means brings said respective opposite end zones to said respective opposite sides before said second means applies said tapes to said handle.

This method and apparatus provide a simple manner of producing an article with a handle attached.

According to a third aspect of the present invention, there is provided in combination, an article and a handle adhesively attached together at respective opposite sides of the article by respective portions of tape extending over respective end zones of said handle at said respective opposite sides and not being portions of said handle, wherein the improvement is that said handle has no self-adhesive surfaces.

According to a fourth aspect of the present invention, there is provided apparatus for attaching handles to articles, comprising drawing means for drawing off predetermined lengths of a tape-form handle material from a roll of said material, cutting means arranged to cut off the predetermined lengths to form the handles, applying means for applying the handles to the articles, and limiting means interposable between a middle section of each predetermined length and its article for limiting the extent of movement of the cut-off predetermined length towards the article, wherein the improvement comprises gripping means included in said limiting means and for gripping each middle section.

This apparatus improves the accuracy of positioning of the handle on the article.

According to a fifth aspect of the present invention, there is provided apparatus for attaching a handle to an article comprising drawing means for drawing off a predetermined length of a tape-form handle material from a roll of said material, cutting means for cutting off the predetermined length to form the handle, applying means for applying the handle to the article, rigid supporting means supporting said applying means, and conveying means for advancing the article along a path, wherein the improvement comprises driving means arranged to displace said rigid supporting means and thus said applying means along said path while said handle is being secured to said article so that said applying means moves with said article along a part of said path while said handle is being secured to said article.

This apparatus improves the reliability of correct application of the handle to the article as compared to a system wherein the handle is carried to the article as part of a ladder tape assembly.

According to a sixth aspect of the present invention, there is provided a method of attaching together a plurality of compressible articles comprising feeding the articles to a taping station, and automatically and adhesively attaching together at said station articles of a line of articles with tape at respective opposite sides of the line while the articles are in a condition compressed together along said line, wherein the improvement comprises dividing said line into rows of articles prior to said attaching, and attaching together the articles in each separate row while the articles in that row are compressed together.

According to a seventh aspect of the present invention, there is provided apparatus for attaching together a plurality of compressible articles, comprising a taping station including attaching means arranged automatically and adhesively to attach together articles in a line of articles with tape at respective opposite sides of said line, and compressing means arranged to maintain said articles in a condition compressed together along the line while being attached, wherein the improvement comprises dividing means arranged to divide said line into rows of articles prior to said attaching, and said compressing means serving to maintain the articles in each separate row compressed together while being attached together.

Such compression of the articles along the row gives the row a firm character after side-taping.

According to an eighth aspect of the present invention, there is provided a method of attaching together a plurality of articles, comprising feeding the articles to a taping station, and automatically and adhesively attaching together at said station the articles of a row of at least two articles with tape portions at respective opposite sides of the row, wherein the improvement comprises holding apart from each other, as they advance end-to-end through the taping station, each two adjacent rows of a plurality of end-to-end rows each of at least two articles, inserting cutting means into the gap so provided between each two adjacent rows to sever the tape portions at the gap, and folding the severed end zones of the tape portions around their respective article edges and automatically and adhesively attaching those severed end zones to the article faces in the gap.

According to a ninth aspect of the present invention, there is provided apparatus for attaching together a plurality of articles comprising a taping station including attaching means arranged automatically and adhesively to attach together the articles of a row of at least two articles with tape portions at respective opposite sides of said row, wherein the improvement comprises spacing means arranged to hold apart from each other, as they advance end-to-end through the taping station, each two adjacent rows of a plurality of end-to-end rows each of at least two articles, cutting means insertable into the gap so provided between each two adjacent rows to sever tape portions at the gap, and means arranged to fold the severed end zones of the tape portions around their respective row edges and automatically and adhesively to attach these severed end zones to the row faces in the gap.

According to a tenth aspect of the present invention, there is provided a row of at least two articles adhesively attached together with tapes at respective opposite sides of the row, wherein the improvement is that the tapes are folded around those row edges which are at not only the ends of the row but also said opposite sides, and the tapes terminate respective short distances beyond those respective row edges, and those tape portions folded around those row edges are adhesively attached to the end faces of the row.

Such folding around and adhering of the tapes gives a more secure attachment together of the articles.

DESCRIPTION OF THE PREFERRED EMBODIMENTS

Figure 1:
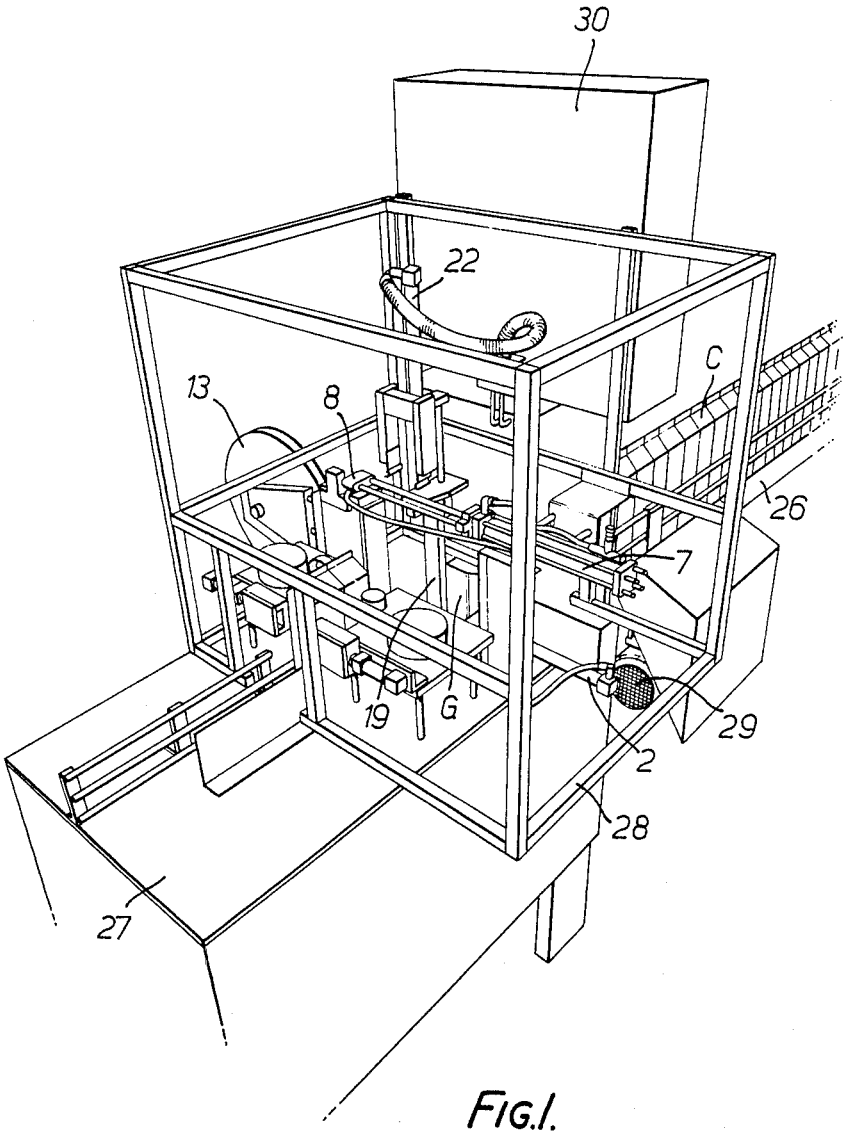
FIG. 1 shows a perspective view of an apparatus for side-taping and applying handles to rows of gable-topped cartons.
Figure 2:
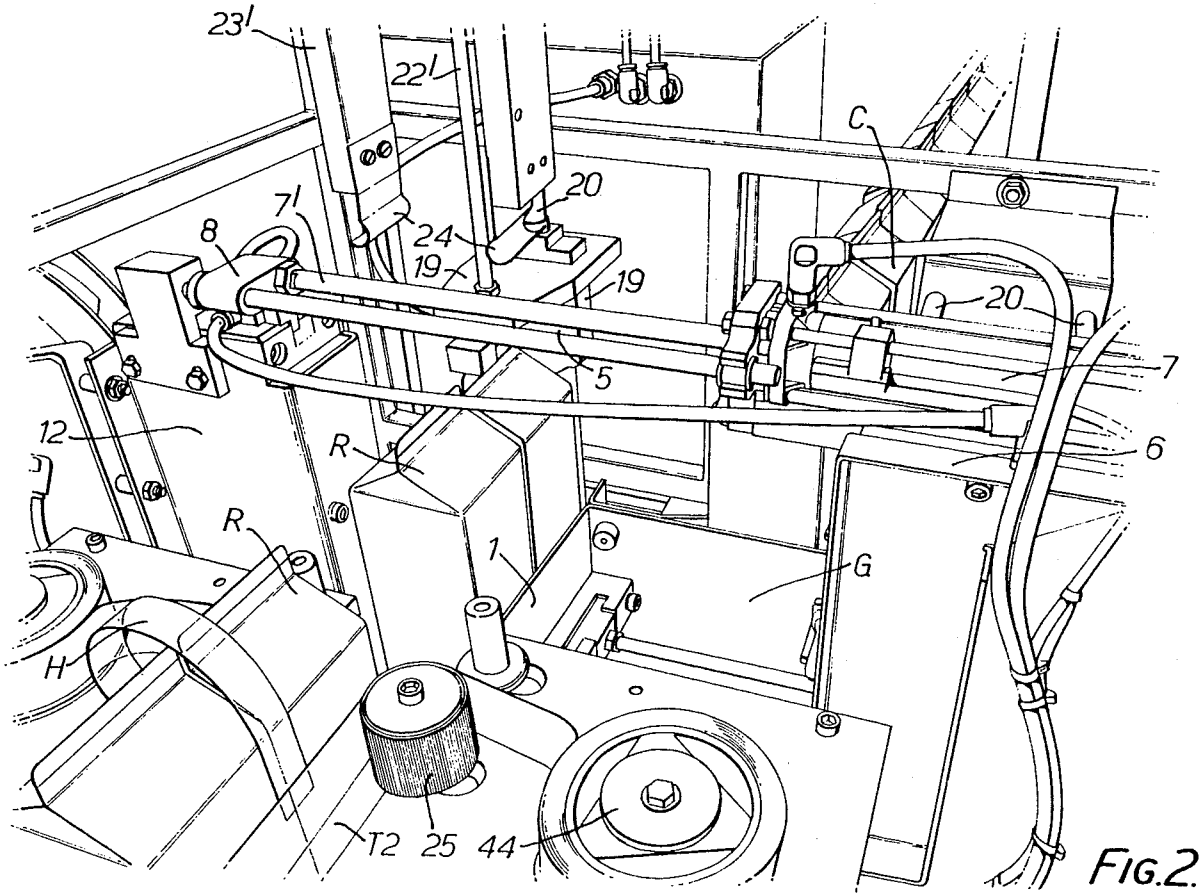
FIG. 2 shows a perspective view of part of the apparatus.
Figures 3, 5:
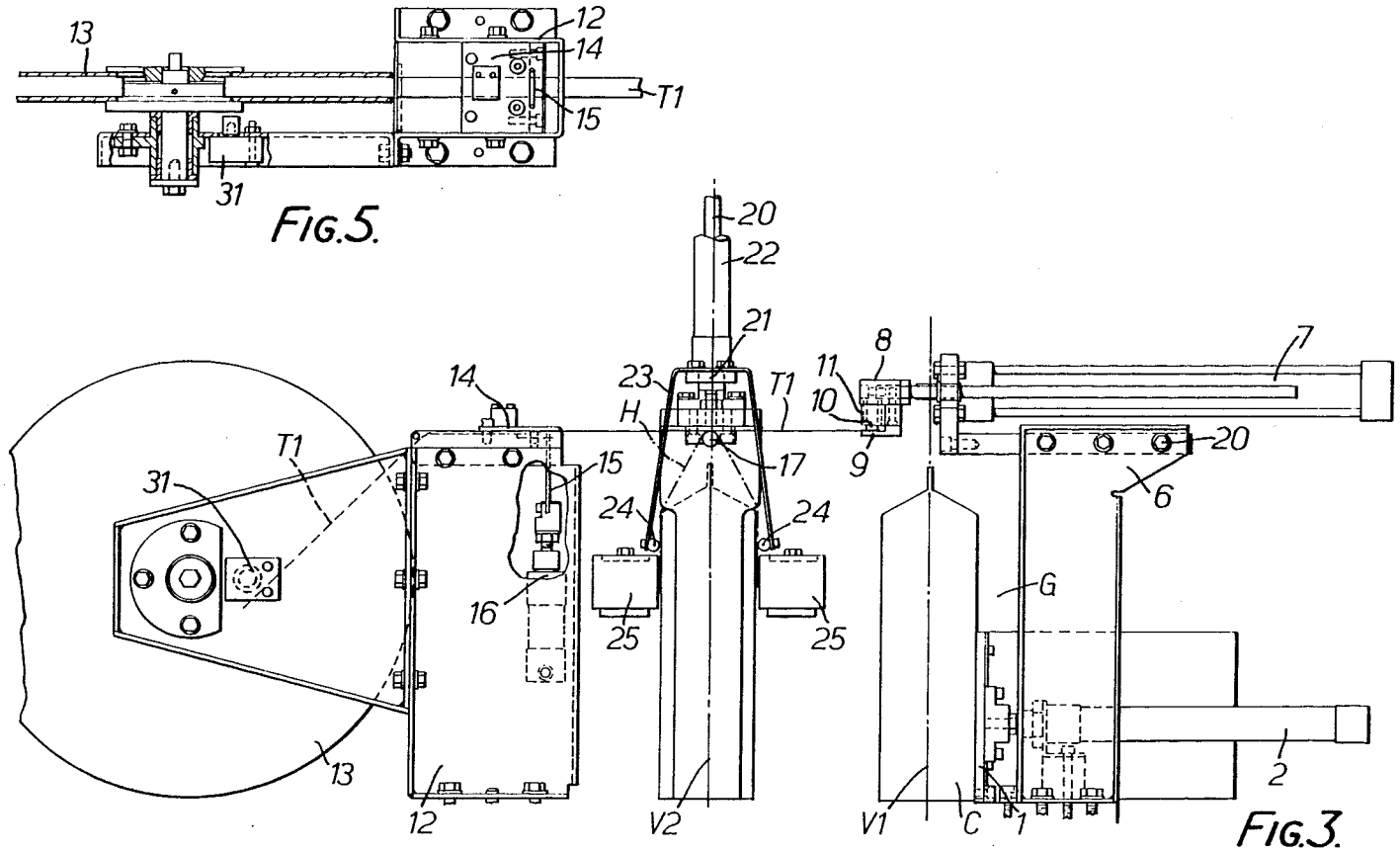
FIG. 3 shows an end elevation of the apparatus.
FIG. 5 shows a sectional plan view of a reel-mounting and tape-cutting and-clamping device of the apparatus.
Figure 4:
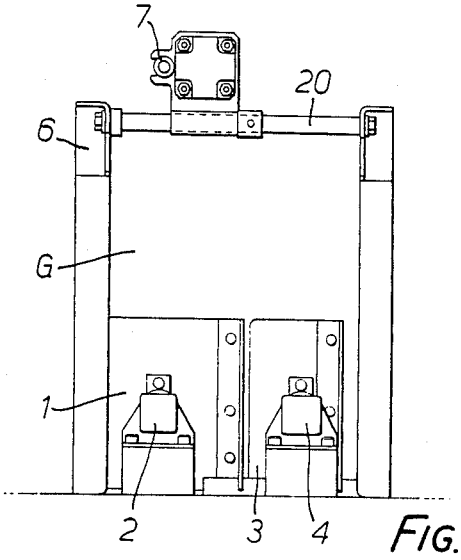
FIG. 4 shows a side elevation of a carton-grouping device included in the apparatus.

Referring to FIGS. 1 to 6, the filled and top-sealed gable-topped cartons C are advanced along a linear horizontal part of the path of the cartons C through the apparatus, which part lies in the vertical plane V1. At a grouping and transfer station G, a row of selectively two or three cartons is pushed laterally by means of either a vertical pusher plate 1 operated by a piston-and-cylinder device 2, or by means of the plate 1 and a vertical pusher plate 3 operated by means of a piston-and-cylinder device 4, until the row of two or three cartons lies in a vertical plane V2 containing a second horizontal linear part of the path of the cartons through the apparatus. The cartons are thereby compressed along the row in a manner to be described with reference to FIG. 8 and loaded onto a carrier 5 serving to convey the cartons along that second horizontal linear part of the path. At the station G, a frame 6 carries a piston-and-cylinder device 7, the piston rod 7' of which supports at its free end a tape-gripping device 8 including a fixed jaw 9 and a moving jaw 10 formed by the piston of a pneumatic piston-and-jaw cylinder device 11. At the opposite side of the station G to the frame 6 is a frame 12 which mounts a reel 13 for rotation about a horizontal axis parallel to the planes V1 and V2 and for carrying a roll of non-adhesive tape T1. The frame 12 also mounts a pneumatically operable clamp 14 and a cutting knife 15 vertically reciprocable by means of a pneumatic piston-and-cylinder device 16. Fixed to the frame 12 is a pneumatically operable clamp 31 which acts at the middle of the reel 13 to prevent overrun thereof. The tape T1 extends from the reel 13 and through the clamp 14. In operation, with the clamps 14 and 31 closed and the device 8 in the position shown in FIGS. 1 and 2, the device 8 grips the free end of the tape T1 projecting from the clamp 14, the clamps 14 and 31 are then opened, and while the device 2 or the devices 2 and 4 are pushing the row of cartons onto the carrier 5, the device 8 draws the tape T1 off the roll until the position of the device 8 shown in FIG. 3 is reached.

Figure 7:
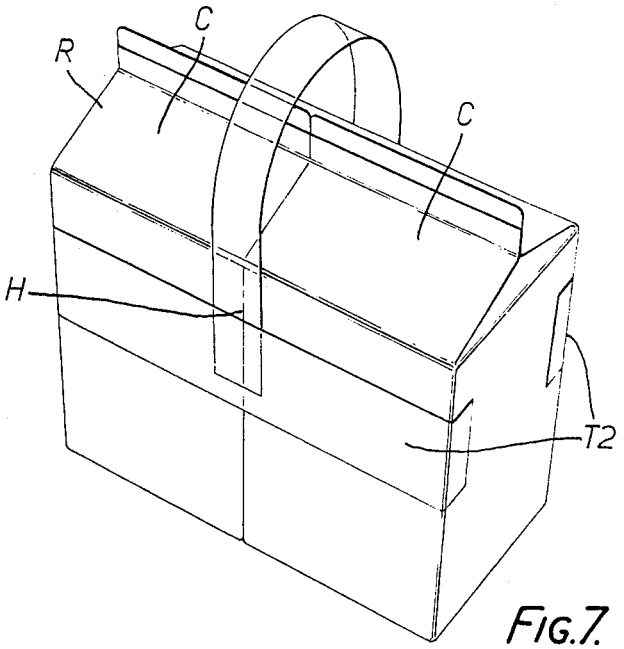
FIG. 7 shows a perspective view of a row of cartons side-taped and handled by the apparatus.
Figure 6:
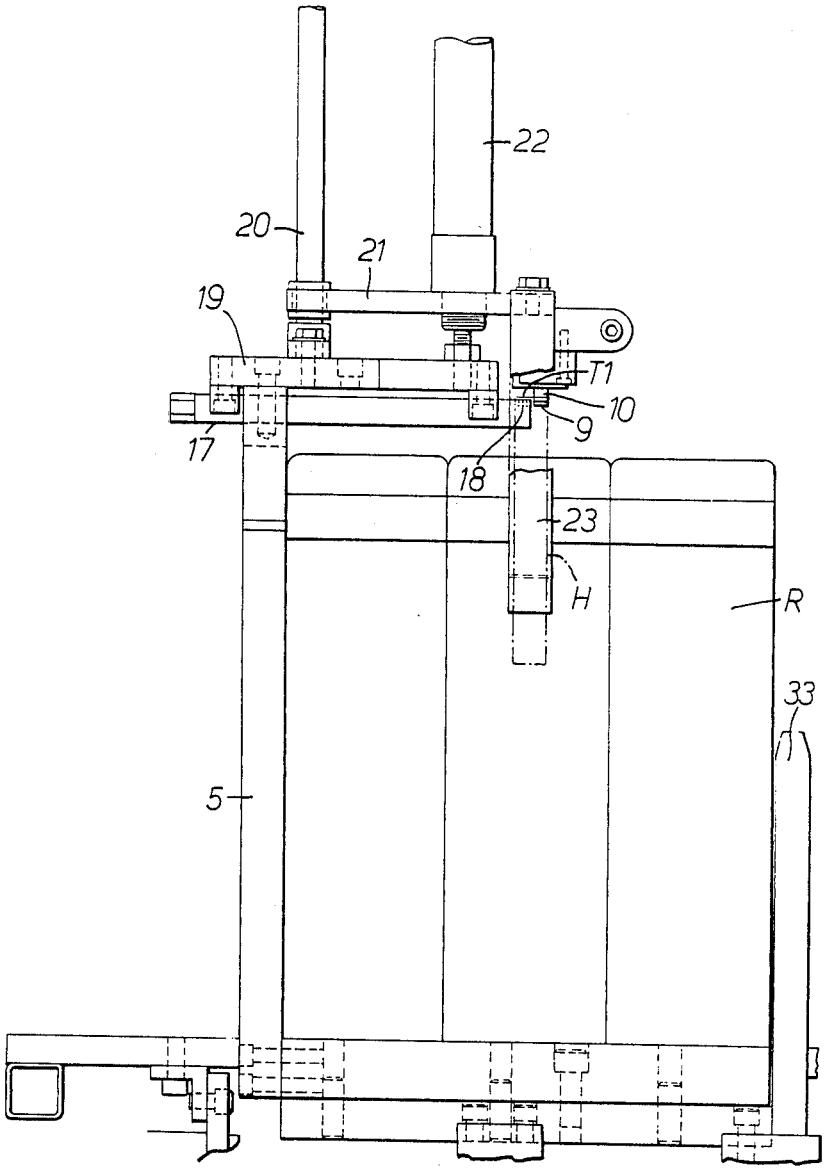
FIG. 6 shows a side elevation of a carton-conveying and -handling device of the apparatus.

The jaws 9 and 10 as a pair occupy almost half of the width of the tape T1 (see FIG. 6). The device 8 is thus able to draw the tape T1 over a tape-seizing member in the form of an air pipe 17 which extends beneath the other half of the width of the tape and is there formed in its upper part with perforations 18. The pipe 17 extends horizontally in the plane V2 and is supported on a bracket 19 of the carrier 5 in such a manner as to be adjustably displaceable longitudinally for appropriate setting dependent upon whether the handle is to be applied centrally of a group of three cartons, as shown in FIG. 6, or centrally of a group of two cartons, as shown in FIG. 7. Similarly, the tape-drawing device 7, 8 is adjustable along bars 20 of the frame 6 parallelly to the planes V1 and V2, whilst the frame 12 is bodily adjustable in the same horizontal direction for the same purpose. With the tape T1 drawn off to the desired length, suction is applied to the tube 17, the clamps 14 and 31 are closed, the knife 15 is operated to sever the tape T1, and the device 8 releases the free end zone of the tape. Thereupon the two end zones of the severed length fall down towards the carton row under their own weight. Fixed to the bracket 19 is a vertical guide rod 20 serving to guide an encircling end of a horizontal strap 21 to which is fixed the cylinder of a pneumatic piston-and-cylinder device 22 whereof the piston rod 22' is fixed to the bracket 19. The device 22 serves to lift and lower a spring steel fork 23 (see FIG. 3), or a rigid steel fork 23' with spring steel end zones (see FIG. 2), fixed centrally to the strap 21 and provided at its free ends with respective cylindrical pressing projections 24. Following severing of the desired tape length, the fork 23 or 23' descends and presses the tape end zones against the respective opposite sides of the carton row. Then the carrier 5 advances through between adhesive-tape-applying rolls 25 of the side-taping device, so as not only to cause the cartons of the row to be taped together, but also to cause the free end zones of the tape handle, the movement of which is restrained by the suction pipe 17 and the fork 23 or 23', to be taped in as well. Once the carton row has passed through the side-taping device, the fork 23 and 23' is raised, the pipe 17 is converted to blowing air out of the perforations 18 and then the carrier 5 is retracted back to the station G, the pipe 17 being thereby withdrawn from beneath the handle H. Upon arrival at the station G, the carrier 5 receives the next row of cartons.

The cartons C approach the station G upon a conveyor 26 and continue through the apparatus by sliding upon a table 27 which carries a frame 28 with transparent panes defining a chamber with an entry for the cartons to be side-taped and handled, an exit for the taped and handled rows, and an entry for the tape T1. A device 29 supplies dehumidified warm air to the chamber, so that condensation onto the walls of the cartons owing to the filling thereinto of cold products is discouraged and the adhesive side tapes T2 adhere more readily thereto. The operation of the apparatus is controlled by a programmable controller 30. It is possible to adjust the length of the handle H by adjusting the stroke length of the device 8 and by adjusting the position of the frame 12 perpendicularly to the planes V1 and V2.

Figure 8:
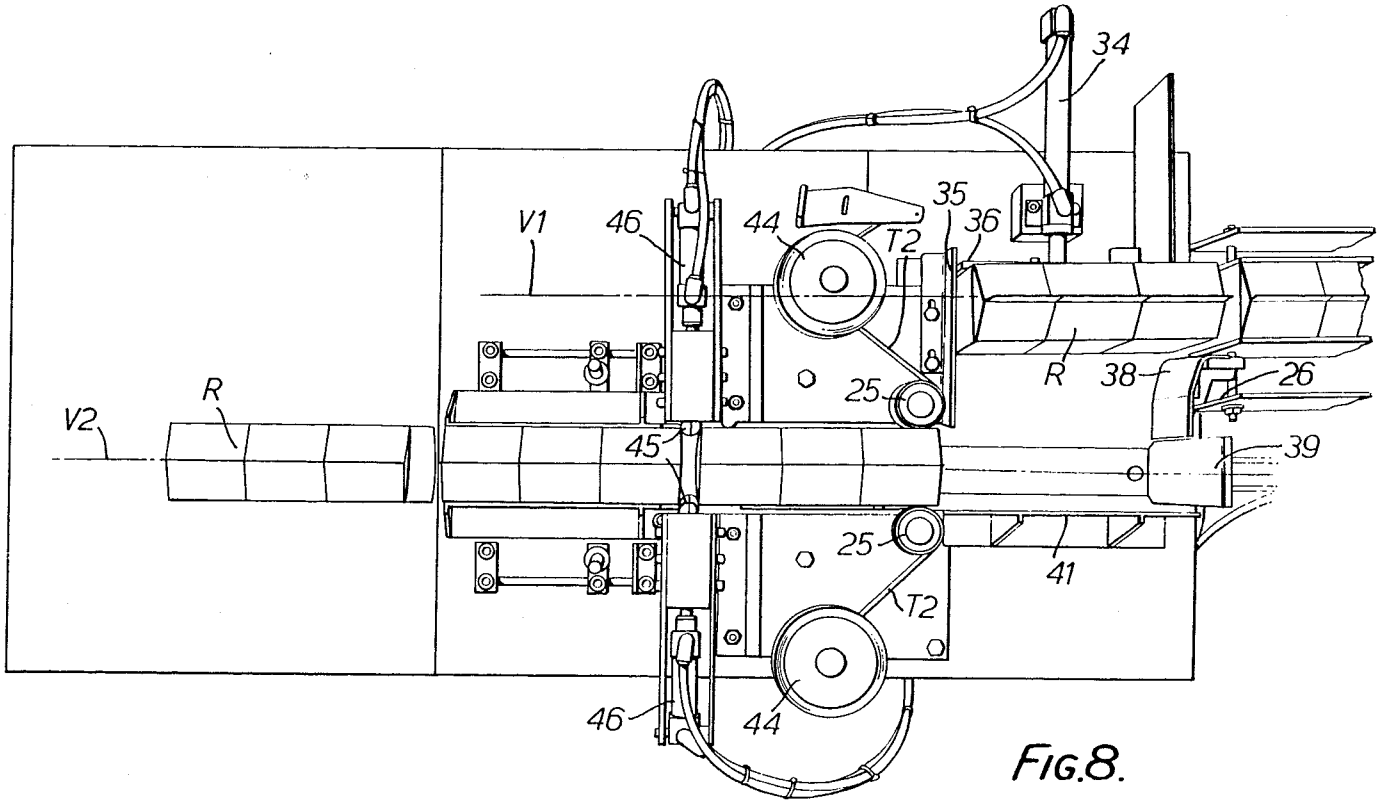
FIG. 8 shows a plan view of a modified version of the carton-grouping, conveying and side-taping mechanisms of the apparatus.

Referring to FIG. 8, the leading carton is arrested by a stop plate 35 fixed to the table 27, the plate 35 extending perpendicularly to the planes V1 and V2. Extending parallely to those planes is a pusher plate 36 which extends along almost three cartons. Although the three cartons adjacent the pusher plate 36 are shown as being spaced slightly ahead of the cartons on the conveyor 26, they will in practice be touching each other. The pusher plate 36 is operated by a pneumatic piston-and-cylinder device 34 so as to move a row of three cartons at a time onto the carrier 5, the respective ends of the row being guided by the plate 35 and a guide plate 38 initially converging towards the plate 35 and also fixed to the table 27. The convergence of the plate 38 causes the three cartons to be squeezed firmly together. The carrier 5 has a rear vertical end plate 39, and a front vertical end plate (33 in FIG. 6) which is downwardly retractable by means of a pneumatic piston-cylinder device (not shown) carried by the carrier 5. The two end plates keep the cartons squeezed firmly together. The carrier 5 is horizontally reciprocable in the plane V2 by means of a pneumatic piston-and-cylinder device (not shown). The three cartons are prevented from moving beyond the carrier by a vertical plate 41 extending parallely to the plane V2. The carrier 5, with its front vertical end plate (33) raised, pushes the row of three squeezed-together cartons through between the pair of rolls 25 which are at the same horizontal level as each other and which press onto respective opposite sides of the row respective adhesive tapes T2 from respective reels 44, the rolls 25 and the reels 44 being idlers having respective vertical axes of rotation. At the end of the forward stroke of the carrier 5, the front vertical end plate (33) is retracted downwards and the carrier 5 withdrawn to its position shown in FIG. 8. The adhesive tapes T2 applied to respective opposite sides of the row by the rolls 25 prevent the row from returning with the carrier 5. The front vertical plate (33) in advancing with the carrier pushes forwards a preceding row of three cartons to which the tapes T2 have already been applied. A pair of knives 45 horizontally reciprocable perpendicularly of the rows by piston-and-cylinder devices 46 is shown in almost its innermost condition in FIG. 8. The knives 45 include respective vertical blades, the cutting edges of which converge to respective points lying in a horizontal plane containing the horizontal centre lines of the respective adhesive tapes T2. These blades initially pierce at the horizontal centre lines and then sever vertically the respective portions of tape bridging the gap between the two adjacent rows. Outwardly of the respective cutting edges of the blades, the knives 45 have respective pairs of rounded shoulders, the shoulders of each pair diverging outwardly to a width greater than that of the gap between the two rows, so that, once the blades have severed the portions vertically, the four free tape end zones thus left are pressed by the rounded shoulders around the adjacent vertical edges of the rows, so that the length of tape along each side of a row leaving the apparatus has its end zones wrapped around a front and a rear vertical edge of the row. The knives 45 are then withdrawn and the next row of three cartons, which has meanwhile been placed upon the carrier 5, is advanced by the carrier to advance the leading rows through the apparatus.

By virtue of adjustment in respect of the plates 35, 36, 38 and 39, and the cutting knives 45, it is possible to alter the number of cartons in each row from three to two or four, for example.

Referring to FIG. 7, the row R of two filled and topped-sealed gable-topped cartons C has been automatically taped along both sides with adhesive tapes T2 as the row R advanced through the taping mechanism. As the row advanced, the handle-feeding and-positioning mechanism advanced with the row the handle H of readily flexible plastics tape, the handle assuming an inverted U-shaped form positioned centrally of the length of the row. As the row and the handle advanced together, the handle H was automatically pressed against the cartons C and adhered to the tapes T2. The lower ends of the U-shaped handle H terminate short of the lower edges of the respective tapes T2 to ensure that the cartons are adhered continuously to the tapes T2 along respective lower edge zones of the tapes T2.

We claim:

1. A method of attaching together an article and a handle, comprising bringing two separate tapes to adjacent to respective opposite sides of the article, bringing respective opposite end zones of the handle to said respective opposite sides of the article, and automatically and adhesively attaching together the tapes, the article and the handle at said respective opposite sides of the article, said respective opposite end zones being brought to said respective opposite sides before said tapes are applied to said handle.

2. A method according to claim 1, and further comprising gripping a mix section of said handle prior to applying of said handle to said article and holding said middle section spaced from said article during said attaching.

3. A method according to claim 2, wherein aid gripping comprises suction applied to said middle section.

4. A method according to claim 3, and further comprising changing said suction to blowing after attachment to the article.

5. Apparatus for attaching together an article and a handle, comprising first means arranged to bring respective opposite end zones of the handle to respective opposite sides of the article, and second and third means at said respective opposite sides and arranged to bring respective separate tapes to adjacent to said respective opposite sides of the article and arranged automatically and adhesively to attach together the tapes, the article and the handle at said respective opposite sides of the article, said first means being arranged to bring said respective opposite end zones to said respective opposite sides before said second and third means apply said tapes to said handle.

6. Apparatus according to claim 5, wherein said first means comprises gripping means arranged to grip a middle section of said handle prior to applying of said handle to said article and to hold said middle section spaced from said article during the attaching together of the tapes, the article and the handle.

7. Apparatus according to claim 6, wherein said gripping means comprises suction aperture means.

8. Apparatus according to claim 5, and further comprising conveying means arranged to advance said article along a path, said first means comprising applying means arranged to apply said handle to said article, rigid supporting means supporting said applying means and driving means arranged to displace said rigid supporting means and thus said applying means along said path while said handle is being attached to said article so that said applying means moves with said article along a part of said path while said handle is being attached to said article.

9. In combination, an article and a handle adhesively attached together at respective opposite sides of the article by respective separate tapes extending over respective opposite end zones of said handle at said respective opposite sides and not being portions of said handle said handle having no self adhesive surfaces.

10. A combination according to claim 9, wherein said tapes are folded around those article edges which are at not only the ends of the article but also said opposite sides, said tapes terminating respective short distances beyond said article edges, and those tape portions folded around those article edges being adhesively attached to the end faces of the article.

11. Apparatus for attaching handles to articles, comprising drawing means for drawing off predetermined lengths of a tape-form handle material from a roll of said material, cutting means arranged to cut off the predetermined lengths to form the handles, applying means for applying the handles to the articles, and limiting means interposable between a middle section of each predetermined length and its article for limiting the extent of movement of the cut-off predetermined length towards the article, wherein the improvement comprises gripping means included in said limiting means and for gripping each middle section.

12. Apparatus for attaching a handle to an article comprising drawing means for drawing off a predetermined length of a tape-form handle material from a roll of said material, cutting means for cutting off the predetermined length to form the handle, applying means for applying the handle to the article, rigid supporting means supporting said applying means, and conveying means for advancing the article along a path, wherein the improvement comprises driving means arranged to displace said rigid supporting means and thus said applying means along said path while said handle is being secured to said article so that said applying means moves with said article along a part of said path while said handle is being secured to said article.

13. A method of attaching together a plurality of compressible articles, comprising feeding a line of said articles toward a taping station dividing said line into rows of articles, compressing together along the row the articles in each separate row and maintaining them compressed together by first and second abutment members applied to the respective ends of the row, advancing such row and said abutment members together through said station, and automatically and adhesively attaching together at said station the articles in each separate row of articles with tape at respective opposite sides of he row while the articles are in a condition compressed together along said row.

14. A row of at least two articles adhesively attached together with tapes at respective opposite sides of the row, wherein the improvement is that the tapes are folded around those row edges which are at not only the ends of the row but also said opposite sides, and the tapes terminate respective short distances beyond those respective row edges, and those tape portions folded around those row edges are adhesively attached to the end faces of the row.

15. Apparatus for attaching together a plurality of compressible articles, comprising dividing means arranged to divide a line of articles into rows of articles, first and second abutment members applicable to the respective ends of such row to maintain the articles in the row compressed together, a taping station including attaching means arranged automatically and adhesively to attach together the articles in each separate row with tape at respective opposite sides of said row, and advancing means arranged to advance such row in a compressed condition and said first and second abutment members together trough said station.

16. Apparatus according to claim 15, wherein said advancing means comprises a carrier carrying said abutment members and reciprocable into and out of said taping station and arranged to advance said rows in a compressed condition one-by-one through said taping station.

17. Apparatus according to claim 16, and further comprising a pusher plate arranged to displace each row transverse of the row to load the row onto said carrier, and a channel through which the pusher plate displaces each row, said channel narrowing in its dimension which is lengthwise of the row.

18. A method of attaching together a plurality of articles, comprising feeding the articles to a taping station, and automatically and adhesively attaching together at said station the articles of a row of at least two articles with tape portions at respective opposite sides of the row, wherein the improvement comprises holding apart from each other, as they advance end-to-end through the taping station, each two adjacent rows of a plurality of end-to-end rows each of at least two articles, inserting cutting means into the gap so provided between each two adjacent rows to sever the tape portions at the gap, and folding the severed end zones of the tape portions around their respective article edges and automatically and adhesively attaching those severed end zones to the article faces in the gap.

19. Apparatus for attaching together a plurality of articles comprising a taping station including attaching means arranged automatically and adhesively to attach together the articles of a row of at least two articles with tape portions at respective opposite sides of said row, wherein the improvement comprises spacing means arranged to hold apart from each other, as they advance end-to-end through the taping station, each two adjacent rows of a plurality of end-to-end rows each of at least two articles, cutting means insertable into the gap so provided between each two adjacent rows to sever tape portions at the gap, and means arranged to fold the severed end zones of the tape portions around their respective row edges and automatically and adhesively to attach these severed end zones to the row faces in the gap.

* * * * *

UNITED STATES PATENT AND TRADEMARK OFFICE

CERTIFICATE OF CORRECTION

PATENT NO. : 4,819,410

DATED : April 11, 1989

INVENTOR(S) : EDWARD A. SKINNER and DONALD E. HOUSE

It is certified that error appears in the above-identified patent and that said Letters Patent is hereby corrected as shown below:

At column 5, line 50, change "piston-and-jaw cylinder" to --piston-and-cylinder--

At column 8, line 24, change "mix" to --middle--

At column 8, line 28, change "aid" to --said--

At column 10, line 23, change "transverse" to --transversely--

Signed and Sealed this

Tenth Day of October, 1989

*Attest:*

DONALD J. QUIGG

*Attesting Officer*

*Commissioner of Patents and Trademarks*